US012716635B2

(12) United States Patent
Vijayan et al.

(10) Patent No.: US 12,716,635 B2
(45) Date of Patent: Aug. 25, 2026

(54) INFUSED ICE MAKER APPLIANCE

(71) Applicant: Haier US Appliance Solutions, Inc., Wilmington, DE (US)

(72) Inventors: Vineeth Vijayan, Louisville, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 78 days.

(21) Appl. No.: 18/404,498

(22) Filed: Jan. 4, 2024

(65) Prior Publication Data

US 2025/0224167 A1 Jul. 10, 2025

(51) Int. Cl.
*F25C 1/25* (2018.01)

(52) U.S. Cl.
CPC ..... *F25C 1/25* (2018.01); *F25C 2300/00* (2013.01); *F25C 2400/14* (2013.01)

(58) Field of Classification Search
CPC .... F25C 1/25; F25C 2300/00; F25C 2400/14; F25C 1/18; A23G 9/083
USPC ..... 62/66
See application file for complete search history.

(56) References Cited

U.S. PATENT DOCUMENTS 2,237,525 A 4/1941 Nolan
2,918,803 A 12/1959 Bauerlein et al.
3,423,209 A * 1/1969 Weber ..... A47J 31/40 99/302 R
4,073,159 A * 2/1978 Trippi ..... F25C 1/25 62/340
4,319,698 A * 3/1982 Tomiyama ..... G07F 13/065 62/400
4,880,547 A * 11/1989 Etani ..... C02F 1/688 210/764
4,987,746 A * 1/1991 Roberts ..... F25C 1/25 62/340
5,549,219 A * 8/1996 Lancaster ..... B67D 1/0857 222/1
6,351,966 B1 * 3/2002 Hochberg ..... B67D 3/0029 62/340
6,513,337 B1 * 2/2003 Astvatsatrian ..... A23G 9/32 62/340
6,619,051 B1 * 9/2003 Kilawee ..... A61L 2/24 62/348

(Continued)

FOREIGN PATENT DOCUMENTS

BR PI0608648 A2 * 1/2010 ..... A47J 31/005
CN 1100195 A * 3/1995 ..... F25C 1/24

(Continued)

*Primary Examiner* — Eric S Ruppert
*Assistant Examiner* — Kirstin U Oswald
(74) *Attorney, Agent, or Firm* — Dority & Manning, P.A.

(57) ABSTRACT

An ice maker appliance includes a mold body, a pod receiver slot upstream of the mold body, and a mixing chamber downstream of the pod receiver slot and upstream of the mold body. The mixing chamber is configured to retain an amount of water and an additive, whereby the additive mixes with the amount of water in the mixing chamber upstream of the mold cavity to form a volume of liquid. Thus, the volume of liquid which comprises the additive and the amount of water may be received by a mold cavity in the mold body, and an ice piece may be formed in the mold cavity, the ice piece containing the amount of water and the additive.

19 Claims, 16 Drawing Sheets

(56) References Cited

U.S. PATENT DOCUMENTS 6,672,097 B1 * 1/2004 Ashley ..... A23G 9/163 62/340
7,135,108 B1 * 11/2006 Barnes ..... C02F 1/78 210/120
8,056,588 B2 * 11/2011 Somerby ..... B01F 35/2211 141/105
8,387,516 B1 * 3/2013 Reynolds ..... A47J 31/56 99/305
8,794,126 B2 8/2014 Skalski et al.
9,038,410 B2 5/2015 Erbs et al.
9,066,529 B2 6/2015 Fassberg et al.
9,759,470 B2 9/2017 Zisholtz et al.
9,999,863 B2 * 6/2018 Jeong ..... B01F 23/2362
10,378,806 B2 8/2019 Boarman et al.
2008/0041070 A1 * 2/2008 Johnson ..... F25C 1/04 62/340
2009/0120306 A1 5/2009 DeCarlo et al.
2009/0241782 A1 * 10/2009 Van Dillen ..... A47J 31/44 137/15.01
2010/0018404 A1 * 1/2010 Villa ..... A47J 31/469 99/295
2010/0159077 A1 * 6/2010 Skalski ..... A47J 31/407 426/80
2010/0263545 A1 * 10/2010 Morgan ..... A47J 31/24 99/295
2012/0192584 A1 * 8/2012 Fiaschi ..... A23G 9/04 62/340
2012/0277906 A1 * 11/2012 Fassberg ..... A23G 9/045 62/126
2014/0242218 A1 * 8/2014 Cho ..... A23L 2/54 426/67
2016/0007794 A1 * 1/2016 Carmichael ..... A23F 5/262 426/433
2016/0205988 A1 7/2016 Bird et al.
2016/0216020 A1 7/2016 Safrin
2017/0042181 A1 * 2/2017 Fiaschi ..... A23G 9/04
2017/0099855 A1 * 4/2017 Cocchi ..... A23G 9/166
2018/0008087 A1 * 1/2018 Miller ..... A47J 31/407
2018/0084938 A1 * 3/2018 Sakthivel ..... F25D 23/126
2018/0213819 A1 * 8/2018 Jetton ..... B01F 23/511
2018/0299190 A1 * 10/2018 Sakthivel ..... B67D 1/0888
2018/0317524 A1 * 11/2018 Jennings, III ..... B01F 35/833
2018/0354773 A1 * 12/2018 Cronin ..... A47J 31/521
2019/0320842 A1 * 10/2019 De'Longhi ..... A47J 31/5255
2019/0328170 A1 * 10/2019 Cai ..... A47J 31/407
2020/0216257 A1 * 7/2020 Zappoli ..... B65D 85/8046
2020/0347535 A1 * 11/2020 Jung ..... D06F 29/00
2021/0052105 A1 * 2/2021 Bojie ..... A47J 31/0615
2022/0369852 A1 * 11/2022 Abeygunawardana ..... A47J 31/446

FOREIGN PATENT DOCUMENTS

CN 1114410 A * 1/1996
CN 1189600 A * 8/1998 ..... F25C 1/25
CN 1282863 A * 2/2001 ..... F25C 1/25
CN 101871711 B 8/2012
CN 102297551 B 4/2013
CN 103565277 A * 2/2014 ..... A47J 31/3666
CN 103829808 A * 6/2014
CN 203723939 U * 7/2014
CN 206525931 U * 9/2017
DE 20218085 U1 2/2003
EP 1074207 A1 * 2/2001 ..... A47J 31/24
EP 2147621 A1 * 1/2010 ..... A47J 31/56
EP 3153028 A1 * 4/2017 ..... A23G 9/166
EP 3216767 A1 * 9/2017 ..... C02F 1/003
EP 3216768 A1 * 9/2017 ..... C02F 1/68
EP 3463012 B1 * 6/2020 ..... A47J 31/52
GB 2271838 A * 4/1994 ..... F25C 1/24
GB 2299657 A * 10/1996 ..... F04D 13/024
JP H06300402 A * 10/1994 ..... F25C 1/04
JP H07218067 A * 8/1995
JP H07260303 A * 10/1995
JP H07260305 A * 10/1995
JP H07270010 A * 10/1995
JP H07270012 A * 10/1995
JP H07294079 A * 11/1995
JP H11304323 A * 11/1999
KR 100211279 B1 * 7/1999 ..... F25C 1/25
KR 20100008267 A * 1/2010 ..... F25C 1/22
KR 100998198 B1 * 12/2010 ..... F25C 5/08
KR 20120110731 A * 10/2012 ..... F25D 11/00
KR 102087581 B1 * 3/2020 ..... F25C 1/142
WO WO-2008148834 A1 * 12/2008 ..... A47J 31/22
WO WO-2011124440 A1 * 10/2011 ..... F25C 1/08
WO WO-2017143292 A1 * 8/2017 ..... B67D 1/0078
WO WO-2017207588 A1 * 12/2017 ..... A47J 31/52

* cited by examiner

INFUSED ICE MAKER APPLIANCE

FIELD OF THE INVENTION

The present subject matter relates generally to ice maker appliances, and in particular to ice maker appliances configured to produce infused ice from water and an additive such as a flavorant, e.g., ice that is infused with one or more additives.

BACKGROUND OF THE INVENTION

Certain refrigerator appliances include an ice maker. An ice maker appliance may also be a stand-alone appliance designed for use in commercial and/or residential settings. To produce ice, liquid water is directed to the ice maker and frozen. For example, certain ice makers include a mold body for receiving liquid water. In some systems, a working fluid is used to directly cool the mold body, e.g., by conductive heat transfer. In other systems, the air around the mold body may be cooled such that the mold body is indirectly cooled via the air. When the mold body is cooled, directly and/or indirectly, ice may be formed from the liquid water therein. After ice is formed in the mold body, it may be harvested from the mold body and stored within an ice bin or bucket within the refrigerator appliance.

Conventional ice maker appliances are configured for producing ice pieces solely from water, e.g., tap water or other similar water sources. Thus, the resulting ice from such ice maker appliances may be perceived as bland and generally provides little to no flavor or nutrients.

Accordingly, an ice maker with features for producing infused ice from water and an additive, such as a flavorant, electrolytes, vitamins, and/or other similar additives, would be desirable.

BRIEF DESCRIPTION OF THE INVENTION

Aspects and advantages of the invention will be set forth in part in the following description, or may be apparent from the description, or may be learned through practice of the invention.

According to an exemplary embodiment, an ice maker appliance is provided. The ice maker appliance includes a mold body comprising a mold cavity. The mold cavity is configured for receiving a volume of liquid therein and retaining the volume of liquid to form an ice piece in the mold cavity. The ice maker appliance also includes a pod receiver upstream of the mold cavity along a flow path of liquid water. The pod receiver includes a pod receiver slot configured to hold a pod containing an additive. The ice maker appliance further includes a mixing chamber downstream of the pod receiver slot and upstream of the mold body. The mixing chamber is configured to retain an amount of water and the additive, whereby the additive mixes with the amount of water in the mixing chamber upstream of the mold cavity to form the volume of liquid. Thus, the volume of liquid received by the mold cavity comprises the additive and the amount of water and the ice piece formed in the mold cavity is comprised of the amount of water and the additive.

According to another exemplary embodiment, a method of operating an ice maker appliance is provided. The ice maker appliance includes a mold body comprising a mold cavity. The mold cavity is configured for receiving a volume of liquid therein and retaining the volume of liquid to form an ice piece in the mold cavity. The ice maker appliance also includes a pod receiver upstream of the mold cavity along a flow path of liquid water. The pod receiver includes a pod receiver slot configured to hold a pod containing an additive. The ice maker appliance also includes a mixing chamber downstream of the pod receiver slot and upstream of the mold body. The method includes flowing an amount of water through the pod receiver into the mixing chamber and flowing the additive into the mixing chamber. The method also includes retaining the additive and the amount of water in the mixing chamber, and the additive mixes with the amount of water in the mixing chamber upstream of the mold cavity to form the volume of liquid as a result. The method further includes receiving the volume of liquid in the mold cavity, and the volume of liquid includes the additive and the amount of water. The method also includes forming the ice piece in the mold cavity, and the ice piece formed in the mold cavity includes the amount of water and the additive.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
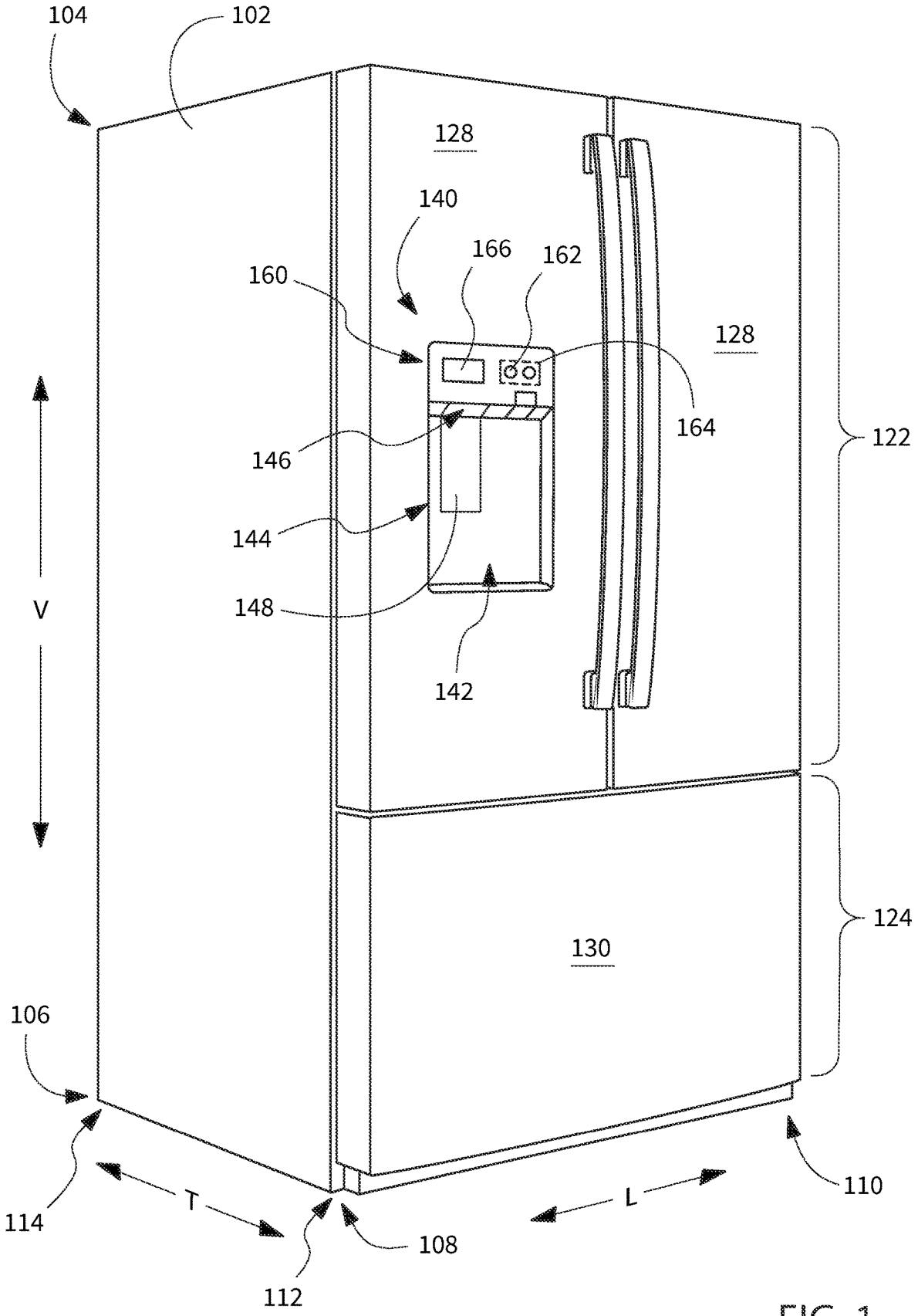
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise. As used herein, the terms "first," "second," and "third" may be used interchangeably to distinguish one component from another and are not intended to signify location or importance of the individual components.

Furthermore, the skilled artisan will recognize the interchangeability of various features from different embodiments. Similarly, the various method steps and features described, as well as other known equivalents for each such methods and features, can be mixed and matched by one of ordinary skill in this art to construct additional systems and techniques in accordance with principles of this disclosure. Of course, it is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

Figure 2:
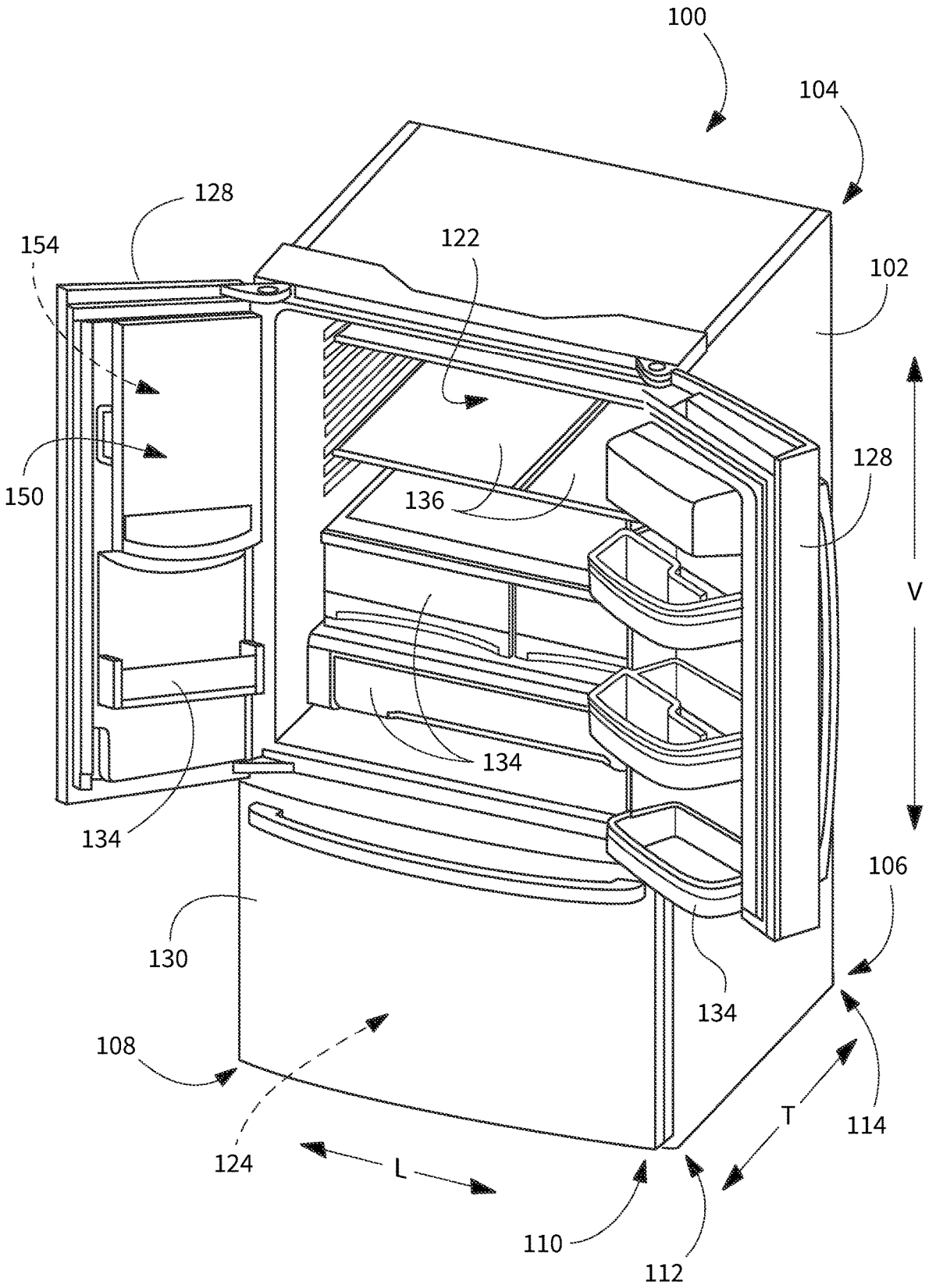
FIG. 2 provides a perspective view of the exemplary refrigerator appliance of FIG. 1, with the doors of the fresh food chamber shown in an open position.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items, etc.) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 may include a sensor (such as an ultrasonic sensor) or a button rather than the paddle. Discharging outlet 146 and actuating mechanism 148 are an external part of ice dispenser 144 and are mounted in dispenser recess 142.

By contrast, inside refrigerator appliance 100, refrigerator door 128 may define an icebox 150 (FIGS. 2 through 4) housing an ice making assembly which includes an ice maker 200 and an ice storage bin 202 that are configured to supply ice to dispenser recess 142. In this regard, for example, icebox 150 may define an ice making chamber 154 for housing an ice making assembly, a storage mechanism, and a dispensing mechanism.

A control panel 160 is provided for controlling the mode of operation. For example, control panel 160 includes one or more selector inputs 162, such as knobs, buttons, touch-screen interfaces, etc., such as a water dispensing button and an ice-dispensing button, for selecting a desired mode of operation such as crushed or non-crushed ice. In addition, inputs 162 may be used to specify a fill volume or method of operating dispensing assembly 140. In this regard, inputs 162 may be in communication with a processing device or controller 164. Signals generated in controller 164 operate refrigerator appliance 100 and dispensing assembly 140 in response to selector inputs 162. Additionally, a display 166, such as an indicator light or a screen, may be provided on control panel 160. Display 166 may be in communication with controller 164, and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible to the processing device, including instructions that can be executed by processing device. Optionally, the instructions can be software or any set of instructions and/or data that when executed by the processing device, cause the processing device to perform operations. For example, the instructions may include a software package configured to operate the system to, e.g., execute the exemplary methods described below. In exemplary embodiments, the various method steps as disclosed herein may be performed, e.g., in whole or part, by controller 164 and/or another, separate, dedicated controller.

Figure 3:
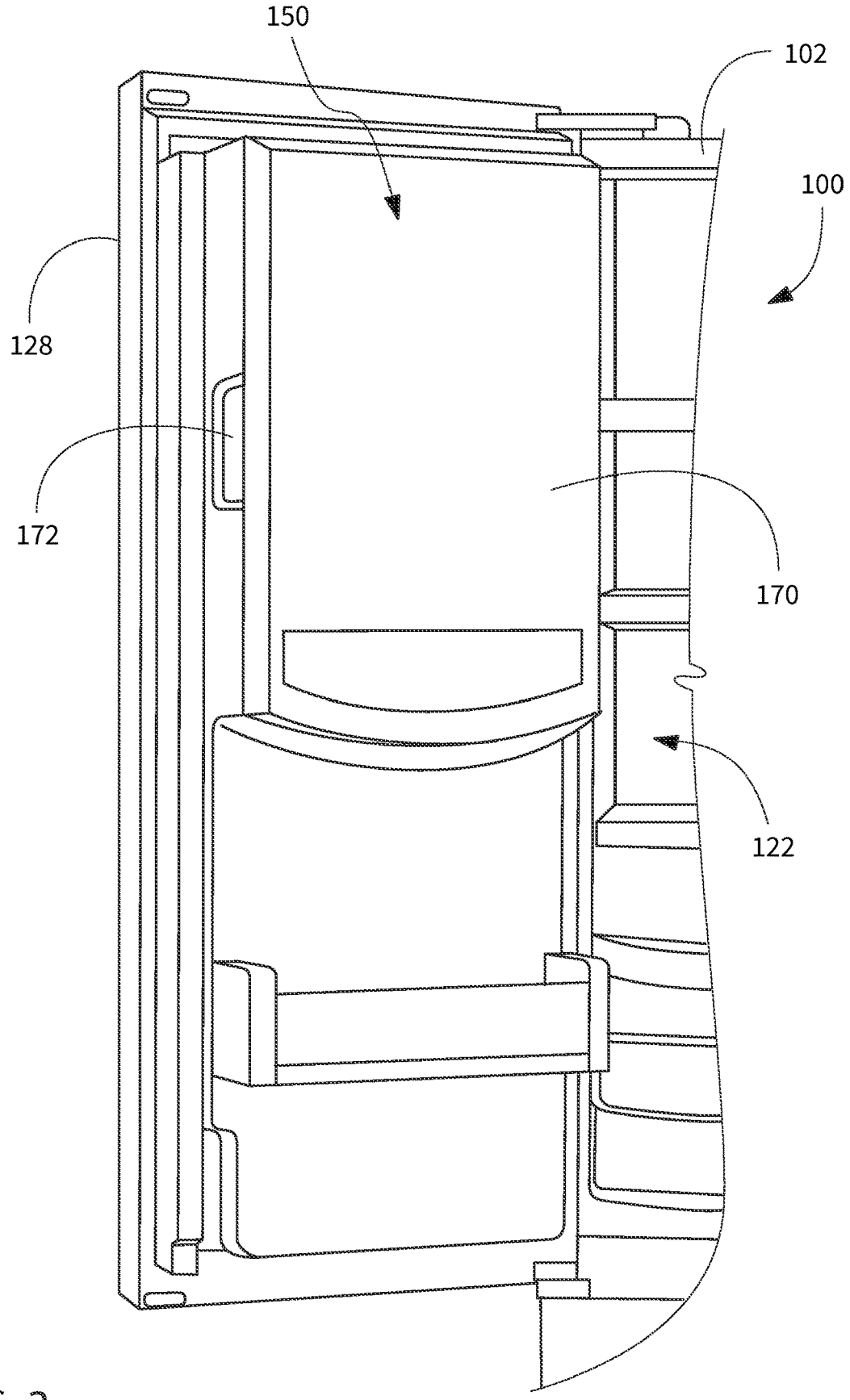
FIG. 3 provides an interior perspective view of a dispenser door of the exemplary refrigerator appliance of FIG. 1.
Figure 4:
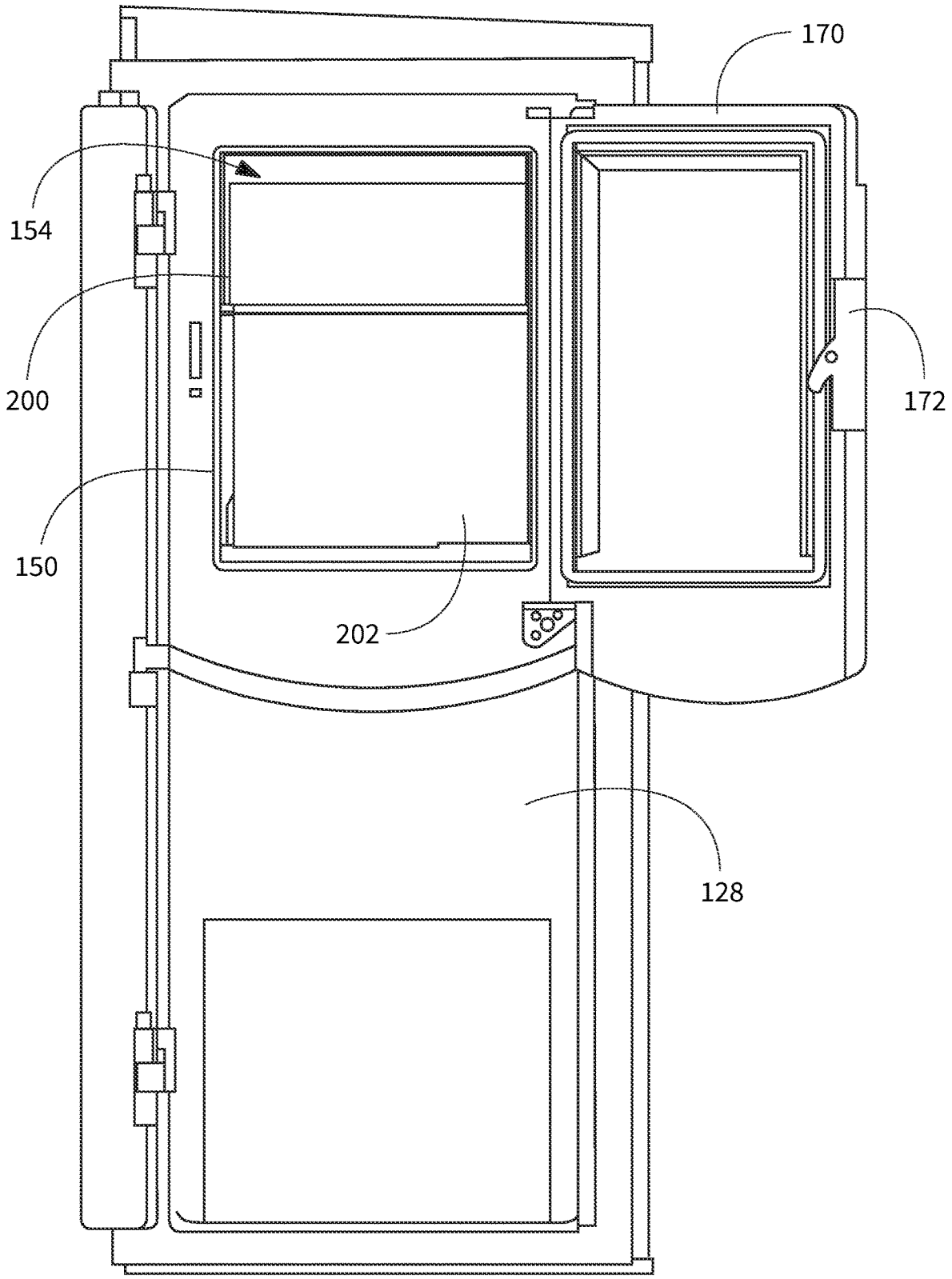
FIG. 4 provides an interior elevation view of the door of FIG. 3 with an access door of the door shown in an open position.

Referring now to FIGS. 3 and 4, FIG. 3 provides an interior perspective view of one of the refrigerator doors 128 and FIG. 4 provides an interior elevation view of the door 128 with an access door 170 shown in an open position. Refrigerator appliance 100 includes a sub-compartment 150 defined on refrigerator door 128. As mentioned above, the sub-compartment 150 may be referred to as an "icebox." In the illustrated exemplary embodiment, icebox 150 extends into fresh food chamber 122 when refrigerator door 128 is in the closed position. As shown in FIG. 4, the ice maker 200 may be positioned within the icebox 150. The ice maker 200 is generally configured for freezing the water to form ice, e.g., ice pieces such as ice cubes, which may optionally be stored in storage bin 202 and dispensed through discharging outlet 146 by dispensing assembly 140. For example, the ice maker 200 may include one or more mold cavities 226 (see, e.g., FIG. 13) defined therein, such as in a mold body 220 thereof, and liquid water may be directed into the mold cavity (or cavities) 226 of the ice maker 200 and the water may then be retained therein at a temperature at or below the freezing point of water to form an ice piece or ice pieces. FIG. 4 illustrates the ice maker 200 with an ice storage bin 202 positioned below the ice maker 200 for receiving ice pieces from the ice maker 200, e.g., for receiving the ice after the ice is ejected from the ice maker 200. As those of ordinary skill in the art will recognize, ice from the ice maker 200 may be collected and stored in the ice storage bin 202 and supplied to dispenser 144 (FIG. 1) from the ice storage bin 202 in icebox 150 on a back side of refrigerator door 128. In additional embodiments, ice from the ice maker 200 may be configured for manual harvest as well as or instead of supplied to the dispenser 144. Chilled air from a sealed system (not shown) of refrigerator appliance 100 may be directed into or onto components within the icebox 150, e.g., ice maker 200 and/or ice storage bin 202.

As mentioned above, the present disclosure may also be applied to other types and styles of refrigerator appliances such as, e.g., a top mount refrigerator appliance, a side-by-side style refrigerator appliance or a standalone ice maker appliance. Variations and modifications may be made to ice making assembly while remaining within the scope of the present subject matter. Accordingly, the description herein of the icebox 150 on the door 128 of the fresh food chamber 122 is by way of example only. In other example embodiments, the ice making assembly may be positioned in the freezer chamber 124, e.g., of the illustrated bottom-mount refrigerator, of a side by side refrigerator, of a top-mount refrigerator, or any other suitable refrigerator appliance. As another example, the ice making assembly may also be provided in a standalone ice maker appliance. As used herein, the term "standalone ice maker appliance" refers to an appliance of which the sole or primary operation is generating or producing ice, e.g., without any additional or other chilled chambers other than the icebox, whereas the more general term "ice maker appliance" includes such appliances as well as appliances with diverse capabilities in addition to making ice, such as a refrigerator appliance equipped with an ice maker, among other possible examples.

As mentioned above, an access door 170 may be hinged to the inside of the refrigerator door 128. Access door 170 permits selective access to icebox 150. Any manner of suitable latch 172 may be configured with icebox 150 to maintain access door 170 in a closed position. As an example, latch 172 may be actuated by a consumer in order to open access door 170 for providing access into icebox 150. Access door 170 can also assist with insulating icebox 150, e.g., by thermally isolating or insulating icebox 150 from fresh food chamber 122.

Figure 5:
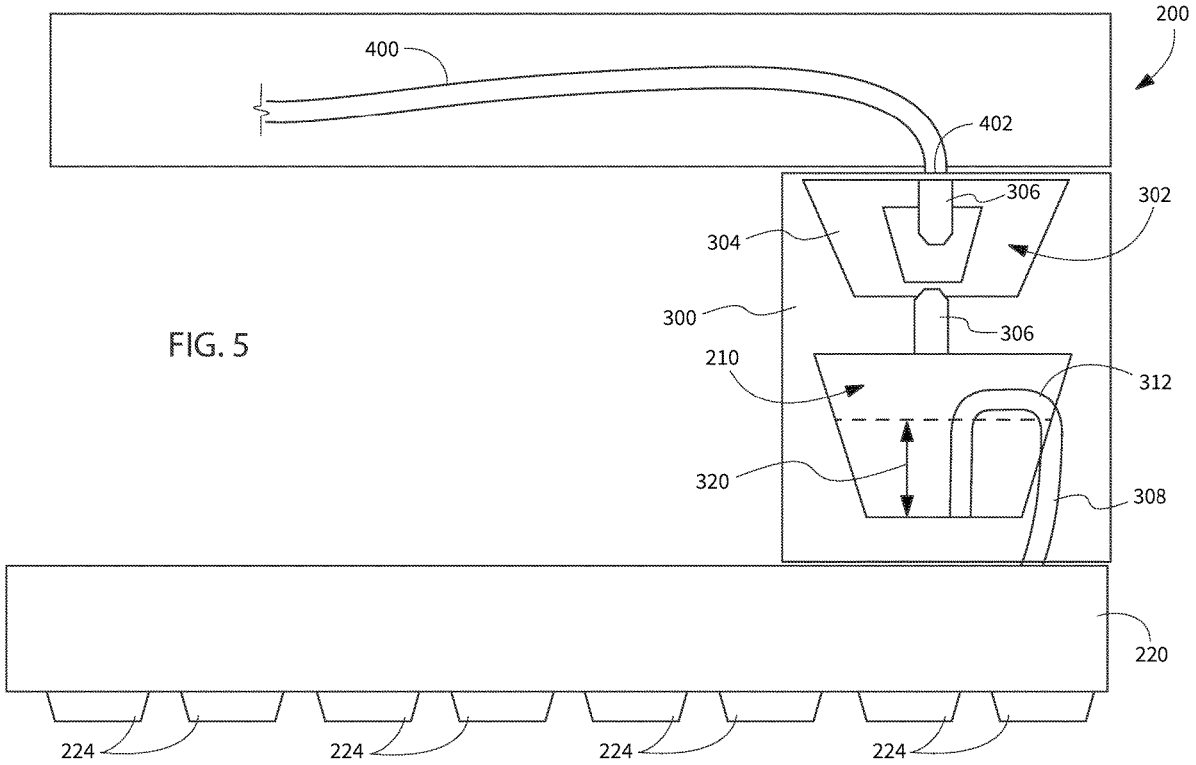
FIG. 5 provides a schematic illustration of an exemplary ice maker in accordance with one or more exemplary embodiments of the present disclosure.
Figure 6:
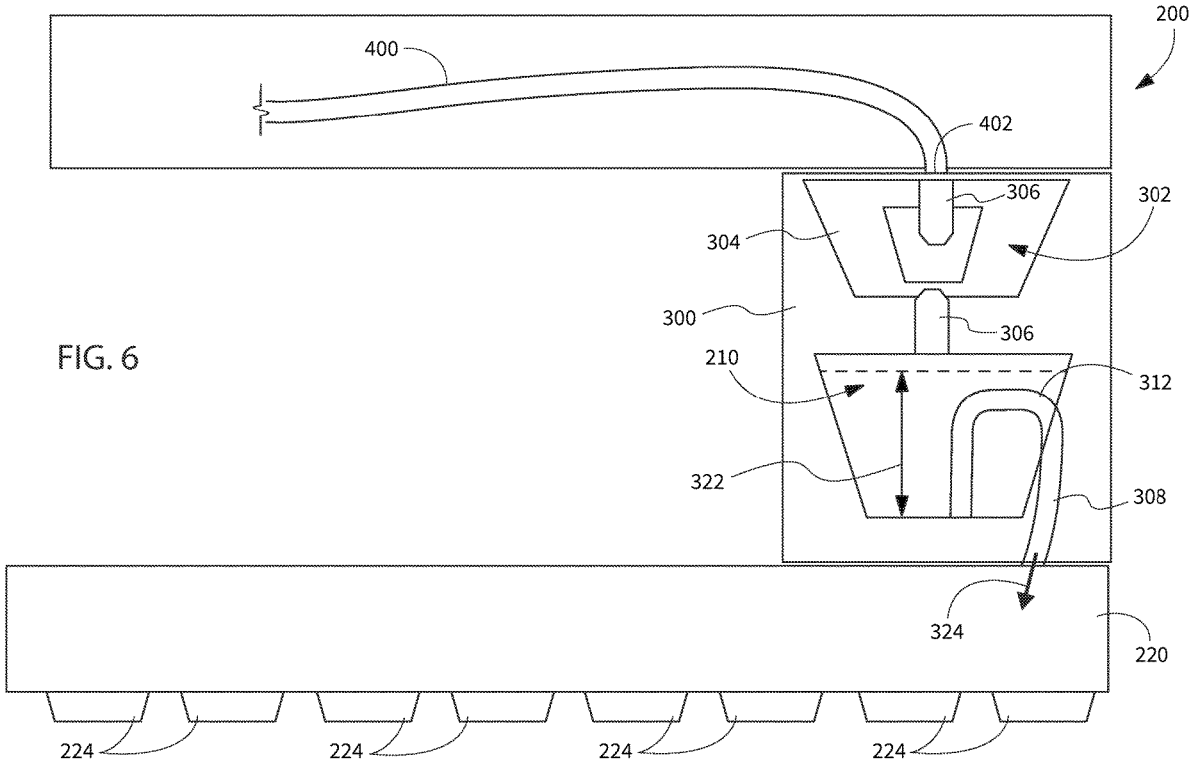
FIG. 6 provides another schematic illustration of the exemplary ice maker of FIG. 5.

Referring now to FIGS. 5 and 6, schematic views of an exemplary embodiment of the ice maker 200 are illustrated.

In some embodiments, e.g., as illustrated in FIGS. 5 and 6, the ice maker 200 may include a mold body 220, and the mold body 220 may include one or more mold cavities 226 (FIG. 13) formed therein. The mold body 220 may also sometimes be referred to as an ice tray.

The mold body 220 of the ice maker 200 may include one or more compartments 224 which define mold cavities 226 (see, e.g., FIG. 14) for receiving a volume of liquid therein, and the liquid may be retained within the compartment(s) 224 until ice is formed. The mold body 220 may comprise a flexible, e.g., twistable, material, such as the mold body 220 may comprise a plastic material which is sufficiently flexible to twist the mold body 220 in order to promote disengagement, e.g., release, of ice pieces in the mold body 220, such release of the ice pieces from within the mold cavities 226 of the mold body 220, as is understood by those of ordinary skill in the art.

The ice maker 200 may further include a pod receiver 300. The pod receiver 300 may be coupled to the mold body 220, and/or may be integrally joined with the mold body 220. The pod receiver 300 may be positioned upstream of the one or more mold cavities 226 along a flow path of the volume of liquid water, such that the liquid water which is to be frozen to form one or more ice pieces therefrom flows through the pod receiver 300 before reaching the mold cavity (or cavities) 226 in the mold body 220. The pod receiver 300 may be coupled to the mold body 220 in various positions, such as at an end of the mold body, e.g., as in the illustrated example embodiments, or in the middle of the body, etc.

The pod receiver 300 may be configured to hold a pod 304 containing an additive, such as the pod receiver may include a pod receiver slot 302 defined therein in which the pod 304 is received. The additive may be provided in any suitable form for mixing with the volume of liquid water as the liquid water flows through the pod receiver 300 and the pod 304 therein. For example, the additive may be a water-soluble powder or may be a liquid, e.g., syrup, or other suitable form, including combinations thereof. The ice maker 200 may also include a mixing chamber 210, and the mixing chamber 210 may be between the pod receiving slot 302 and the mold body 220, such as the mixing chamber 210 may be downstream of the pod receiver slot 302 and upstream of the mold body 220. In some embodiments, the mixing chamber 210 may be integrated in the pod receiver 300, such as downstream of the pod receiver slot 302 within the pod receiver 300.

The pod receiver 300 may include one or more elements for opening or puncturing the pod 304. For example, in some embodiments, one or more sharp tubes or hollow needles 306 may be provided in the pod receiver slot 302, and such hollow needles 306 may pierce the pod 304 when the pod 304 is installed in the pod receiver slot 302, such that fluid communication between the interior of the pod 304 (including the additive, e.g., flavorant, therein) and a water supply line 400 upstream of the mold body 220 is provided, whereby liquid water flows from the water supply line 400 through the pod 304 (whereupon the liquid water may begin to mix with the additive) and then flows from the pod 304 to mixing chamber 210 and then from the mixing chamber 210 to the mold body 220. As diagrammatically depicted in FIGS. 5 and 6, the water supply line 400 may extend within the refrigerator appliance, such as within a wall or partition of the refrigerator appliance, to an outlet 402 which may engage with the ice maker, e.g., with pod receiver 300 of the ice maker, such as at a first sealing member, e.g., gasket, at a water inlet 310 (see, e.g., FIG. 13) of the pod receiver 300. One or more additional sealing members, e.g., gasket(s), may be provided within the pod receiver slot 302 to sealingly engage the pod 304 at the top of the pod 304 and/or at the bottom of the pod 304.

Figure 11:
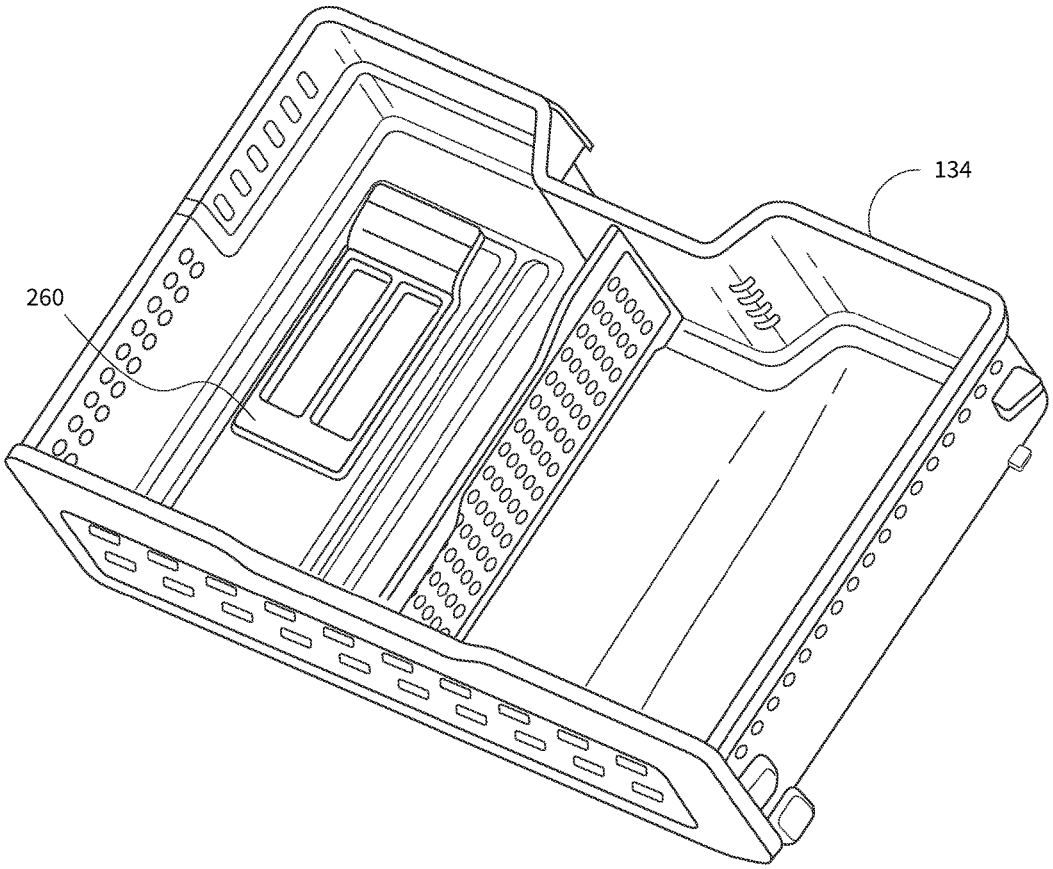
FIG. 11 provides a perspective view of an exemplary component of a refrigerator appliance in which an exemplary removable ice maker in accordance with one or more exemplary embodiments of the present disclosure may be received.
Figure 12:
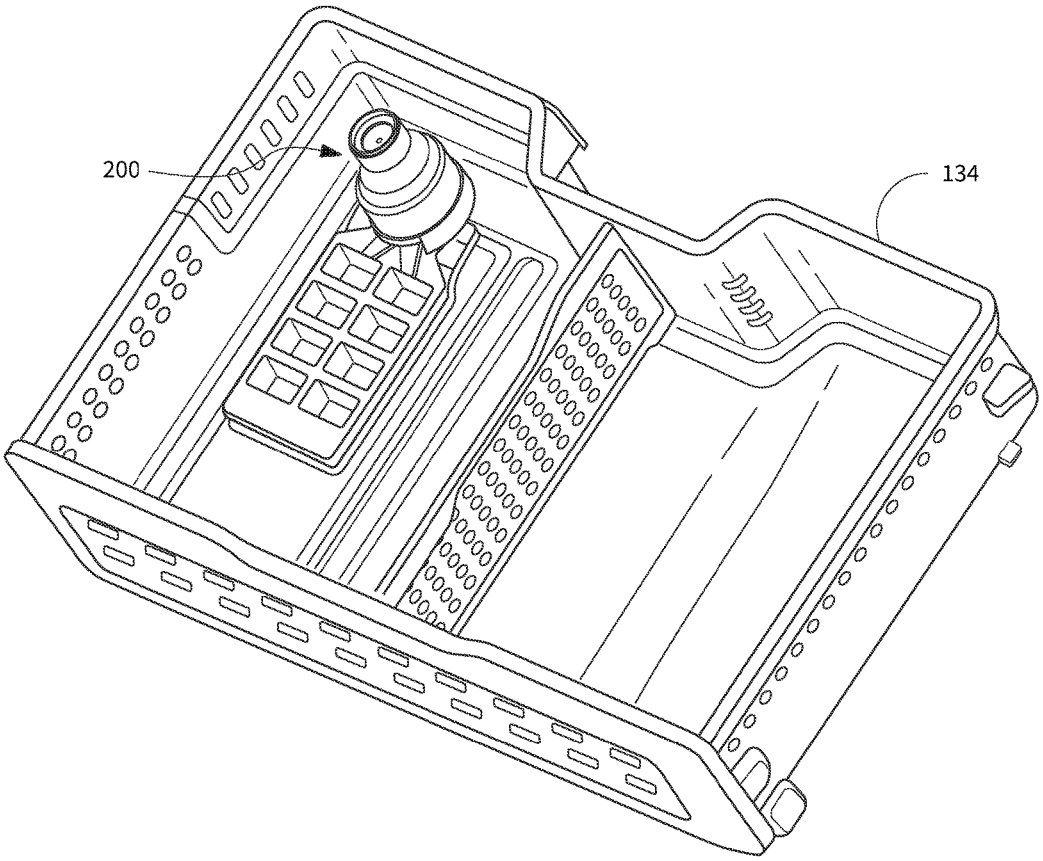
FIG. 12 provides a perspective view of the exemplary component of FIG. 11 with an exemplary ice maker in accordance with one or more exemplary embodiments of the present disclosure received therein.

As may be seen in FIGS. 5 and 6, when the ice maker 200 is installed in the ice maker appliance, e.g., refrigerator appliance 100, such as in freezer bin 134 described below with respect to FIGS. 11 and 12 or in an icebox 150 as described above with respect to FIGS. 3 and 4, water inlet 310 may be below and aligned with the outlet 402 of water supply line 400, to provide a flow of liquid water into and through the pod receiver 300 and the pod 304 therein. Thus, the liquid water flushes the pod 304, e.g., the flow of liquid water through the pod 304 in the pod receiver slot 302 may extract the additive (the additive may be, e.g., a solid powder or liquid form) from the pod 304. Such flow of liquid water, with the additive from the pod 304 as well, may then flow to the mixing chamber 210. For example, the additive from the pod 304 may be entrained in the water flow or partially mixed with the water flow, such that the water flow generally carries or urges the additive from the pod 304 into the mixing chamber 210. Thus, the mixing chamber 210 may receive an amount of water from the water supply line 400 and the additive from the pod 304 into the mixing chamber 210 via the pod receiver slot 302, e.g., the flow of liquid water from water supply line 400 may extract the additive from the pod 304 and transport the additive to the mixing chamber 210. In such embodiments, the additive mixes (or completes mixing) with the amount of water in the mixing chamber 210 upstream of the mold body 220, e.g., upstream of the one or more mold cavities 226 in the mold body 220 to form a volume of liquid from which the infused ice may be formed in the mold body 220, e.g., the volume of liquid from the mixing chamber 210 may be received by and retained in the one or more mold cavities 226 of the mold body 220 and thereby form one or more ice pieces comprising the amount of water and the additive in the one or more mold cavities 226.

In some embodiments, the ice maker 200 may also include a siphon mechanism, such as a siphon tube 308 as illustrated in FIGS. 5 and 6, that extends between the mixing chamber 210 and the mold body 220. In such embodiments, the volume of liquid is received by the mold cavity 226 from the mixing chamber 210 via the siphon mechanism, e.g., siphon tube 308. As mentioned above, a flow of liquid water into and through the pod receiver 300 and the pod 304 therein may be provided from the water supply line 400. For example, as illustrated in FIG. 5, a first flow of liquid water may be provided, which fills the mixing chamber 210 with liquid water and additive from the pod 304 to a first height 320. The first height 320 is below a bend 312 in the siphon tube 308, such that the liquid water and additive remains within the mixing chamber 210 when the mixing chamber 210 is filled to the first height 320. After allowing a certain time period to elapse, such as a predetermined contact time or a predetermined mixing time, a second flow of water may be provided into the mixing chamber 210, such that the amount of water referred to above is provided across two separate flow events. The second flow of water is much smaller than the first flow of water, e.g., is just enough to raise the fill height within the mixing chamber 210 from the first height 320 (FIG. 5) to a second height 322. The second height 322 may be above the bend 312 in the siphon tube 308, such that the siphon is activated after the second fill, causing the volume of liquid (liquid water mixed with additive, as noted above) to flow from the mixing chamber 210 to the mold body 220 through the siphon mechanism, e.g., siphon tube 308. For example, such flow may be as generally indicated by arrow 324 in FIG. 6.

Figure 7:
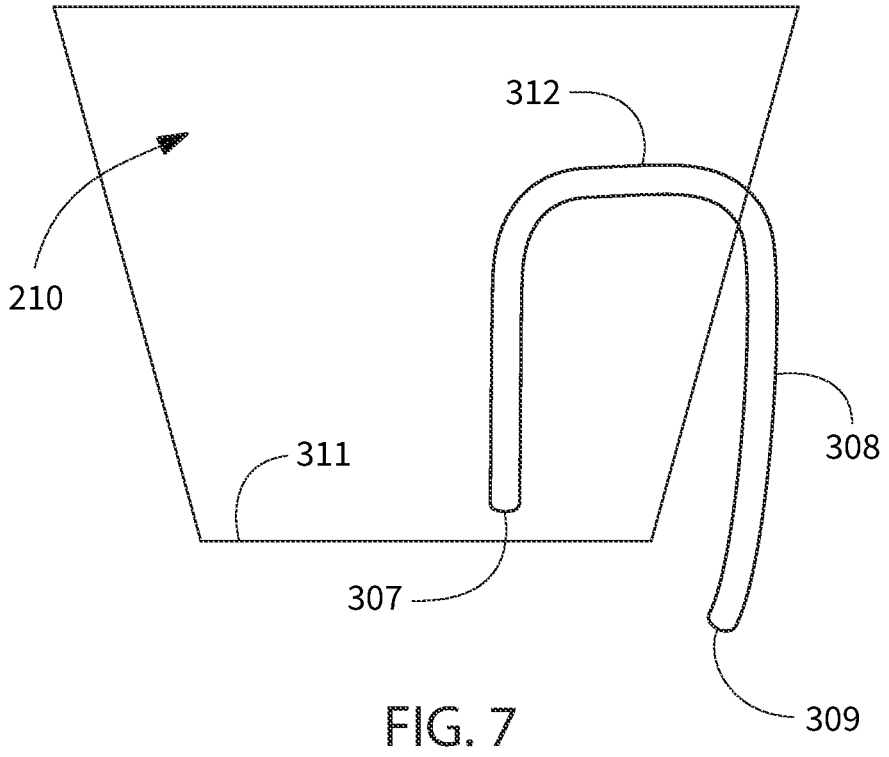
FIG. 7 provides a schematic illustration of an exemplary mixing chamber of an ice maker in accordance with one or more exemplary embodiments of the present disclosure.

Turning now to FIG. 7, in some embodiments, the siphon mechanism may include the siphon tube 308, e.g., as described above, and the siphon tube 308 may extend into the mixing chamber 210. For example, in such embodiments, the siphon tube 308 may extend from an inlet 307 within the mixing chamber 210, upward to a first portion of the bend 312 within the mixing chamber 210, and then out of the mixing chamber 210. In such embodiments, the siphon tube 308 may then extend from a second portion of the bend 312 to an outlet 309. The inlet 307 of the siphon tube 308 may be positioned above and facing towards a floor 311 of the mixing chamber 210.

Figure 8:
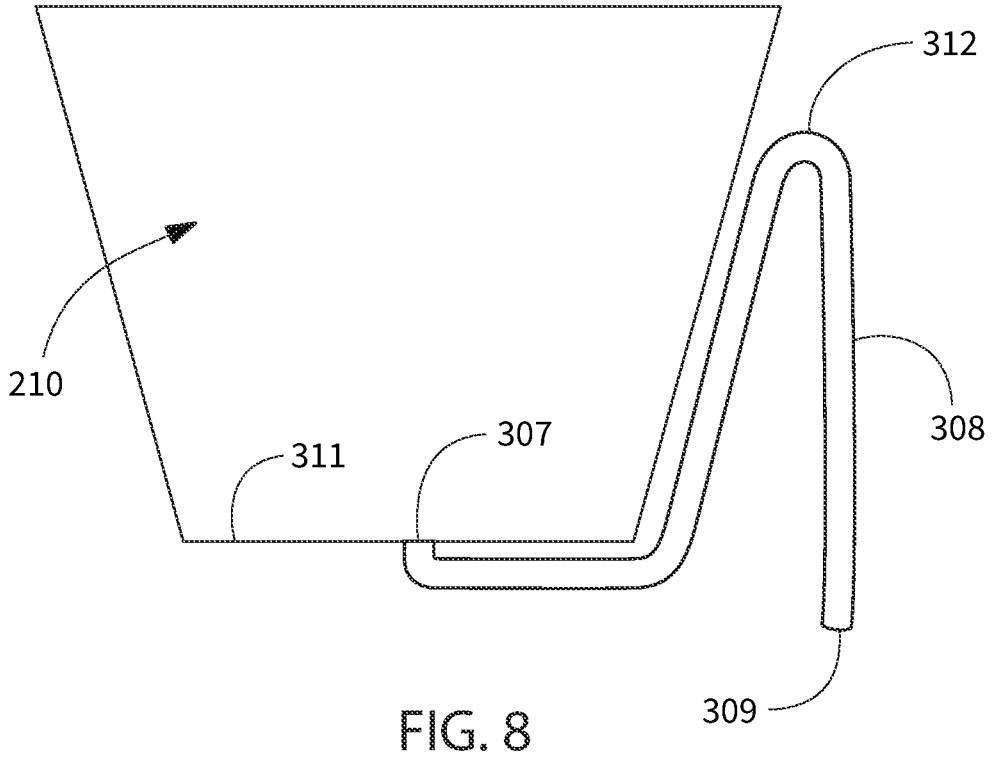
FIG. 8 provides a schematic illustration of another exemplary mixing chamber of an ice maker in accordance with one or more additional exemplary embodiments of the present disclosure.

In some embodiments, e.g., as illustrated in FIG. 8, the siphon tube 308 may be positioned entirely outside of the mixing chamber 210. For example, in such embodiments, the siphon tube 308 may extend downward from the inlet 307 at the floor 311 and may remain outside of the mixing chamber 210 as the siphon tube 308 then extends from the inlet 307 to the bend 312, and from the bend 312 to the outlet 309.

Figure 9:
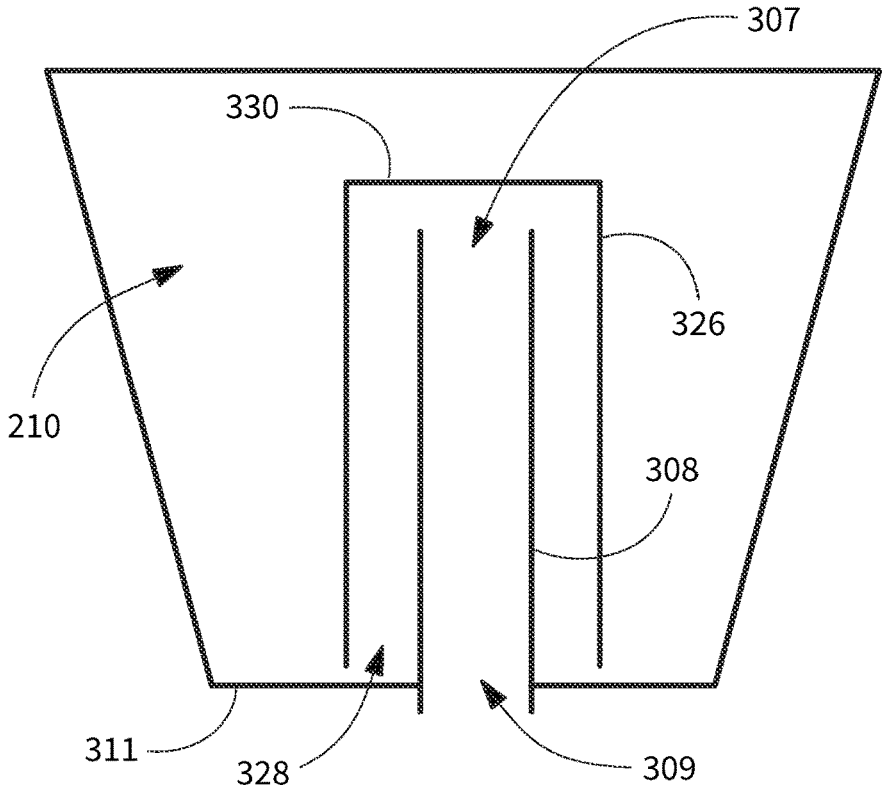
FIG. 9 provides a schematic illustration of yet another exemplary mixing chamber of an ice maker in accordance with one or more further exemplary embodiments of the present disclosure.
Figure 10:
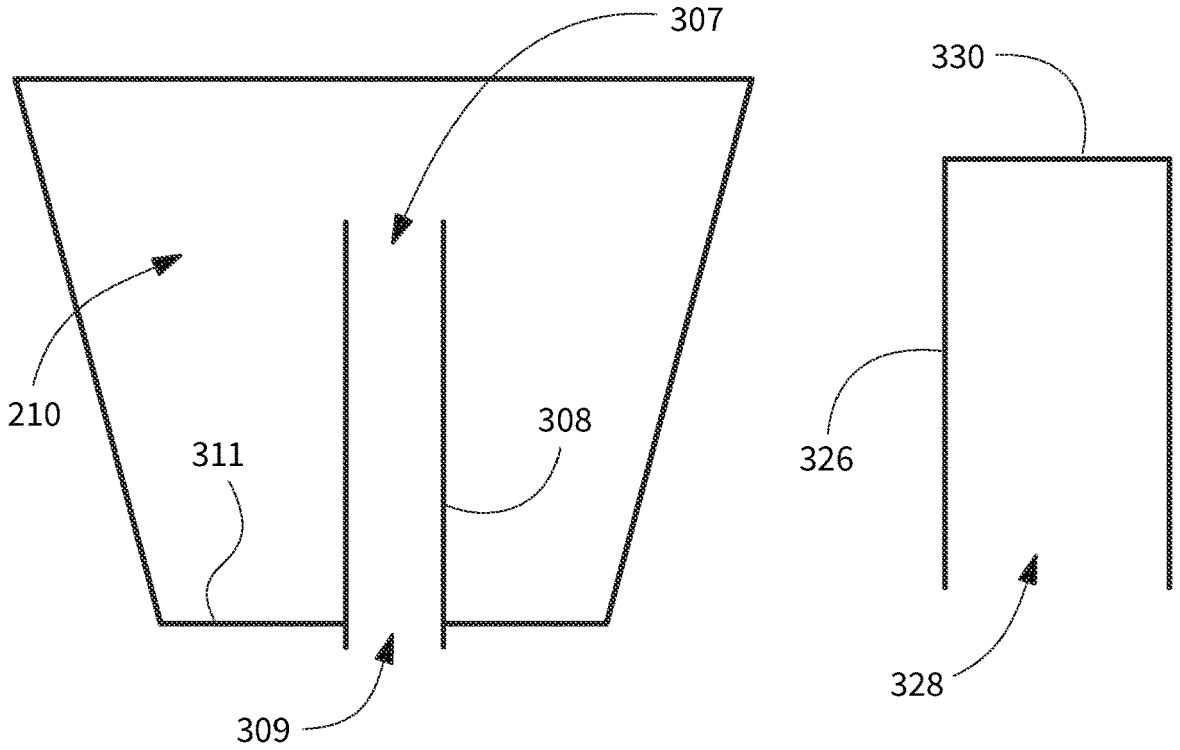
FIG. 10 provides a schematic illustration of the exemplary mixing chamber of FIG. 9 with a removable siphon cap in a detached position.

In some embodiments, e.g., as illustrated in FIGS. 9 and 10, the siphon tube 308 may be a single, straight, generally vertical tube, and the siphon mechanism may further include a removable siphon cap 326. The siphon cap 326 may fit over and around the siphon tube 308, thereby defining a siphon flow path between the siphon cap 326 and the siphon tube 308, e.g., as illustrated in FIG. 9. In such embodiments, the siphon tube 308 may extend through the floor 311 of the mixing chamber 210. For example, the inlet 307 of the siphon tube 308 may be positioned at the top of the siphon tube 308 and the siphon tube 308 may extend downward from the inlet 307 through the floor 311 to the outlet 309 of the siphon tube 308.

The siphon cap 326 may define an inlet 328 at an open bottom end of the siphon cap 326 and an enclosed top end 330 of the siphon cap 326 may be positioned opposite the inlet 328. Thus, when the siphon cap 326 is positioned over and around the siphon tube 308, the siphon flow path may begin at the inlet 328 of the siphon cap 326, may extend between the siphon tube 308 and the siphon cap 326 (e.g., outside of the tube 308 and inside of the cap 326) from the inlet 328 of the siphon cap 326 to the inlet 307 of the siphon tube 308. Once liquid reaches the inlet 307 of the siphon tube 308, such liquid may then flow through the siphon tube 308 to the outlet 309 and may then flow, e.g., to the mold body 220. Accordingly, the height of the siphon tube 308, e.g., the distance from the floor 311 of the mixing chamber 210 to the inlet 307 of the siphon tube, may define the second height to which the mixing chamber 210 may be filled to activate the siphon mechanism and thereby provide the volume of liquid to the mold body 220, e.g., as discussed above with reference to FIGS. 5 and 6.

In some embodiments, e.g., where the ice maker appliance is a refrigerator appliance or stand-alone freezer appliance, the ice maker 200 may be removably positioned within a storage component, e.g., a bin or basket such as an internal freezer bin (e.g., which is entirely within the freezer chamber behind the freezer door when in a retracted position), of the refrigerator or freezer. Bin 134 illustrated in FIG. 11 is an example of such storage component. For example, bin 134 may be a freezer bin configured to slidably mount within the freezer compartment 124 of refrigerator appliance 100. Where refrigerator appliance 100 is a bottom-mount configuration, the top of the ice maker 200, when mounted in the freezer bin 134 and with door 130 in a fully closed position and bin 134 in a fully retracted position, may abut a bottom surface of a horizontal partition which extends across the cabinet and thereby separates and defines the fresh food chamber 122 and the freezer chamber 124. Thus, in such exemplary embodiments, the water supply line 400 which provides liquid water to ice maker 200 may be located in the horizontal partition and the outlet 402 of the water supply line 400 may be located at the bottom surface of the horizontal partition. In such embodiments, a base 260 may be provided in the storage element, e.g., bin 134, such as the exemplary base 260 shown in FIG. 11. The ice maker 200 may be removably mountable on the base 260, e.g., as illustrated in FIG. 12. In such embodiments, the base 260 may be positioned and configured to provide consistent and repeatable location of the ice maker 200 within the ice maker appliance, e.g., within the freezer chamber 124 of refrigerator appliance 100, such as to promote alignment of the ice maker 200, e.g., water inlet port 310 thereof, with the water supply line 400 and outlet 402 of the water supply line 400.

In some embodiments, the ice maker appliance, e.g., refrigerator appliance 100, may be configured to detect when the ice maker, e.g., mold body 220 and pod receiver 300, are installed. The ice maker appliance may also be configured to detect the presence of the pod 304 within the pod receiver 300 when the ice maker 200 is installed. Such embodiments may also include detecting whether the ice maker 200 is installed correctly, e.g., is sufficiently aligned with the water supply line to receive the flow of liquid water without liquid water escaping from the ice maker 200. The pod 304 presence may be detected by any suitable sensor, such as a radio frequency identification (RFID) sensor which detects an RFID tag on the pod 304, a Hall effect sensor which responds to magnetic elements of the pod 304 (e.g., a metallic foil component of the pod 304), a weight sensor, or other similar sensor or combination of sensors. In particular, the sensor may not require a line of sight to the pod, such as detecting the pod based on magnetic fields or radio frequency, as mentioned. In additional embodiments, a transparent window may be provided in the pod receiver such that a line of sight sensor may be used, e.g., an infrared (IR) light based sensor or time of flight sensor. For example, the sensor or sensors which detect the pod may be positioned in the horizontal partition and may be oriented downwards to detect the pod 304 in the pod receiver 300 when the ice maker 200 is installed, e.g., on the base 260 in the bin 134.

Figure 13:
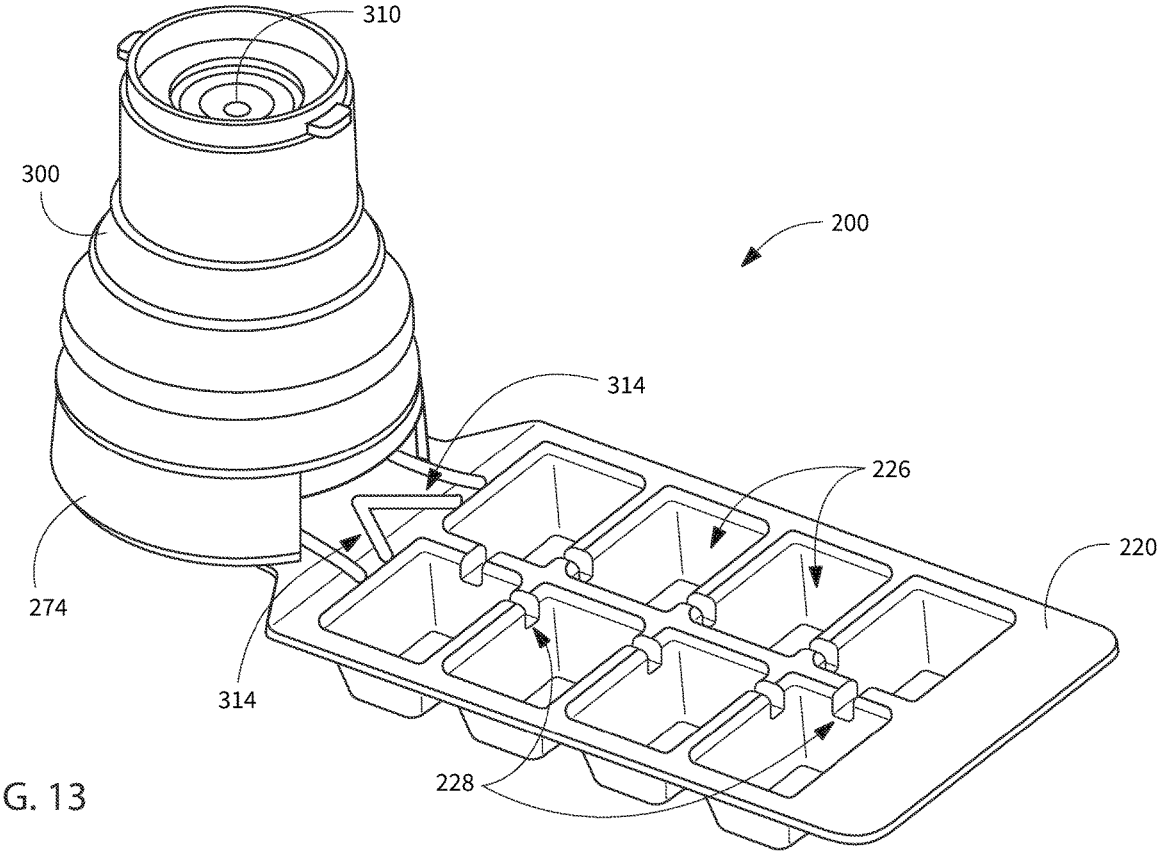
FIG. 13 provides a perspective view of an exemplary pod receiver and an exemplary mold body in accordance with one or more exemplary embodiments of the present disclosure, with the pod receiver and mold body coupled together.
Figure 14:
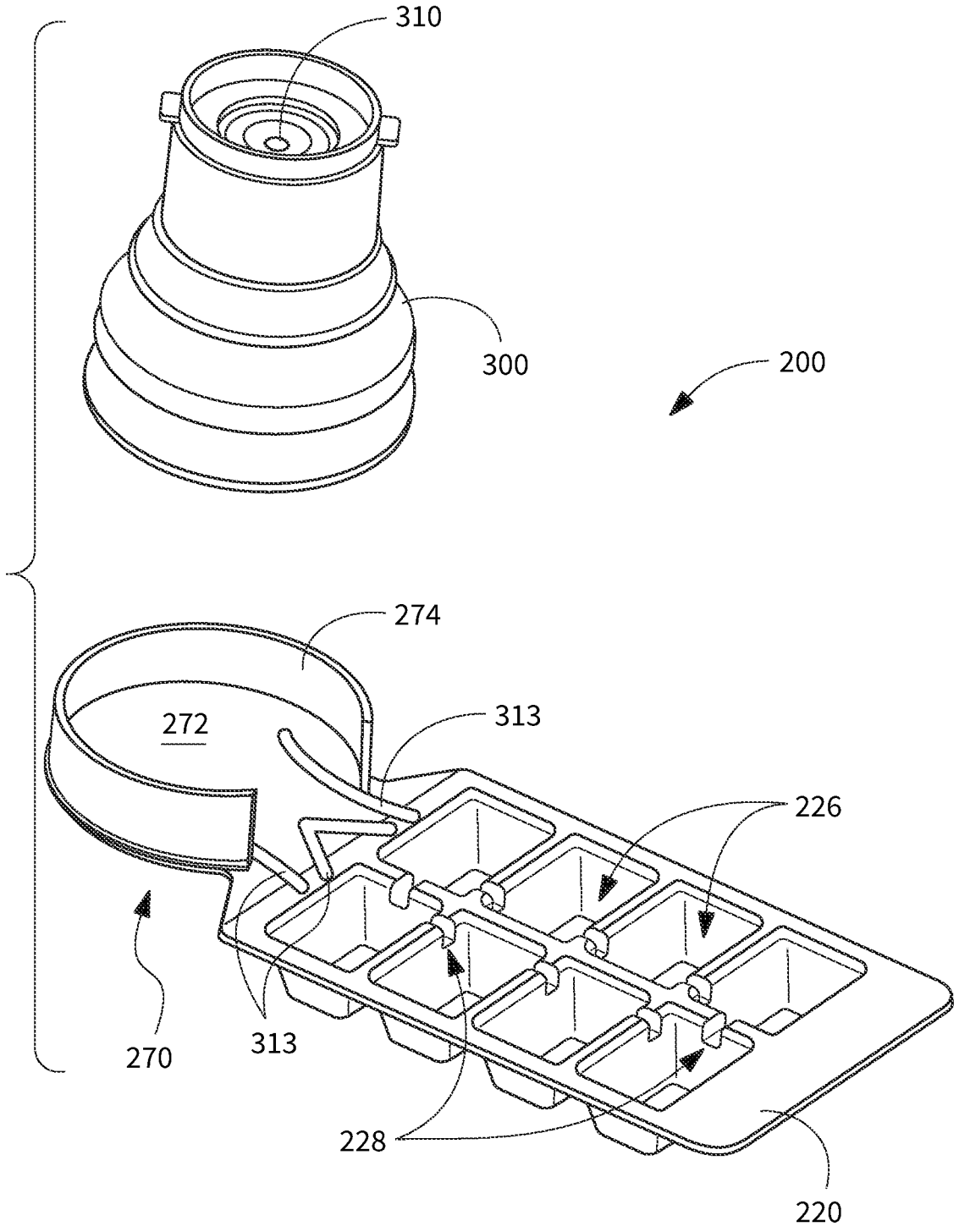
FIG. 14 provides a perspective view of the pod received and mold body of FIG. 13, with the pod receiver and mold body separated from each other.

In some embodiments, the pod receiver 300 may be removable from the mold body 220, e.g., as illustrated in FIG. 14. In such embodiments, a receptacle 270 may be formed on the mold body 220, such as at an end of the mold body 220, or in the middle of the mold body 220, or another suitable location. The receptacle 270 may be generally complimentary in shape to the pod receiver 300. For example, the pod receiver 300 may be round, e.g., circular, and the receptacle 270 may be generally circular (or may form a portion of a circle or other rounded shape when the pod receiver 300 is an other rounded shape) to enclose the pod receiver 300 within the receptacle 270. As illustrated for example in FIG. 14, the receptacle 270 may include a platform 272 which is complementary in shape to a bottom end of the pod receiver 300 and a perimetrical wall 274 which extends around at least a portion of the platform 272. As may be seen in FIGS. 13 and 14, a plurality of ribs 313 may be formed on the mold body 220 and may define one or more conduits or channels 314 between the ribs 313. Thus, the ribs 313 may extend into the receptacle 270 and underneath the pod receiver 300 (when the pod receiver 300 is mounted in the receptacle 270) to guide a flow of liquid water mixed with additive out from the bottom of the pod receiver 300 into one or more mold cavities 226 in the mold body 220. In embodiments where more than one mold cavity 226 is defined in the mold body 220, the mold cavities 226 may be separated and defined by a plurality of walls, and cross flow channels 228 may be defined in the walls between adjoining mold cavities 226, in order to promote even flow and distribution of the mixture of liquid water and additive throughout all of the mold cavities 226. In some embodiments, e.g., as illustrated in FIG. 13, the ice maker 200 may include multiple rows, e.g., two rows, of compartments 224 in the mold body 220, and cross flow channels 228 may be provided between adjacent compartments within the same row and across rows.

The pod receiver 300 may be in fluid communication with the mold body 220 by a channel or conduit 314 downstream of the pod receiver slot 302 and mixing chamber 210, such that liquid water mixed with additive may flow from the pod receiver 300, e.g., from the mixing chamber 210 therein, to the mold body 220, such as to the mold cavity (or cavities) 226 in the mold body 220. The liquid water mixed with additive may be held in the mold cavity 226 and cooled until the mixture freezes, thereby forming one or more enhanced or infused ice pieces, e.g., infused ice pieces comprising both water and the additive.

Figure 15:
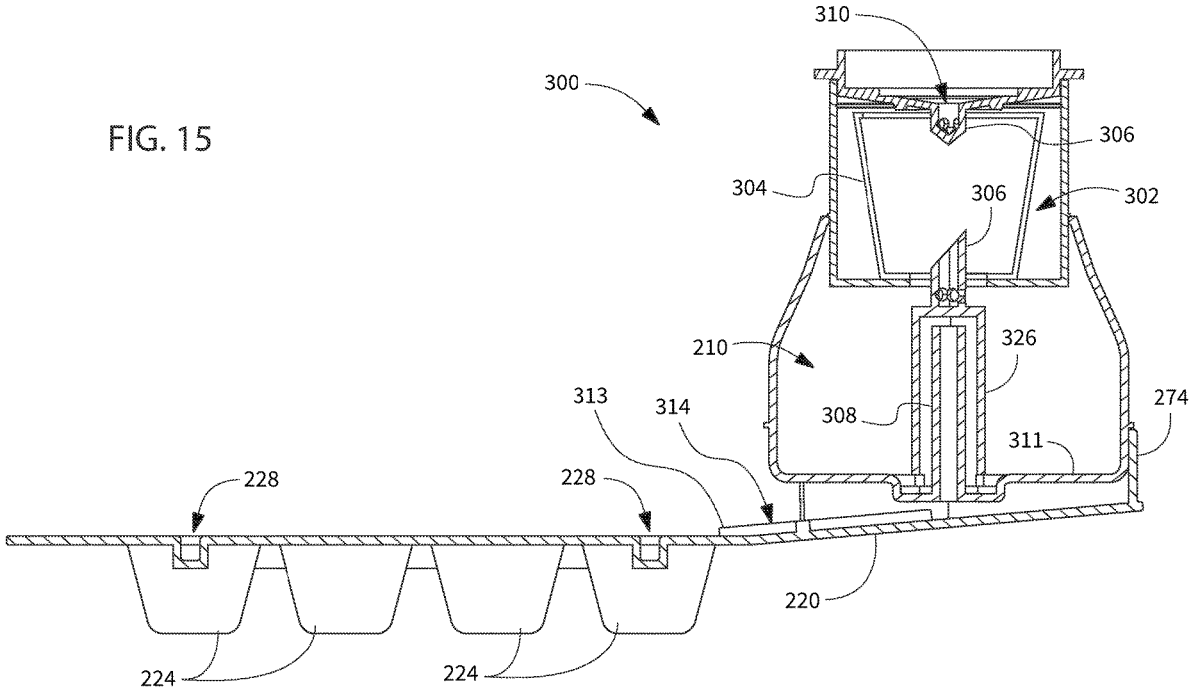
FIG. 15 provides a longitudinal section view of the pod receiver and mold body of FIG. 13.
Figure 16:
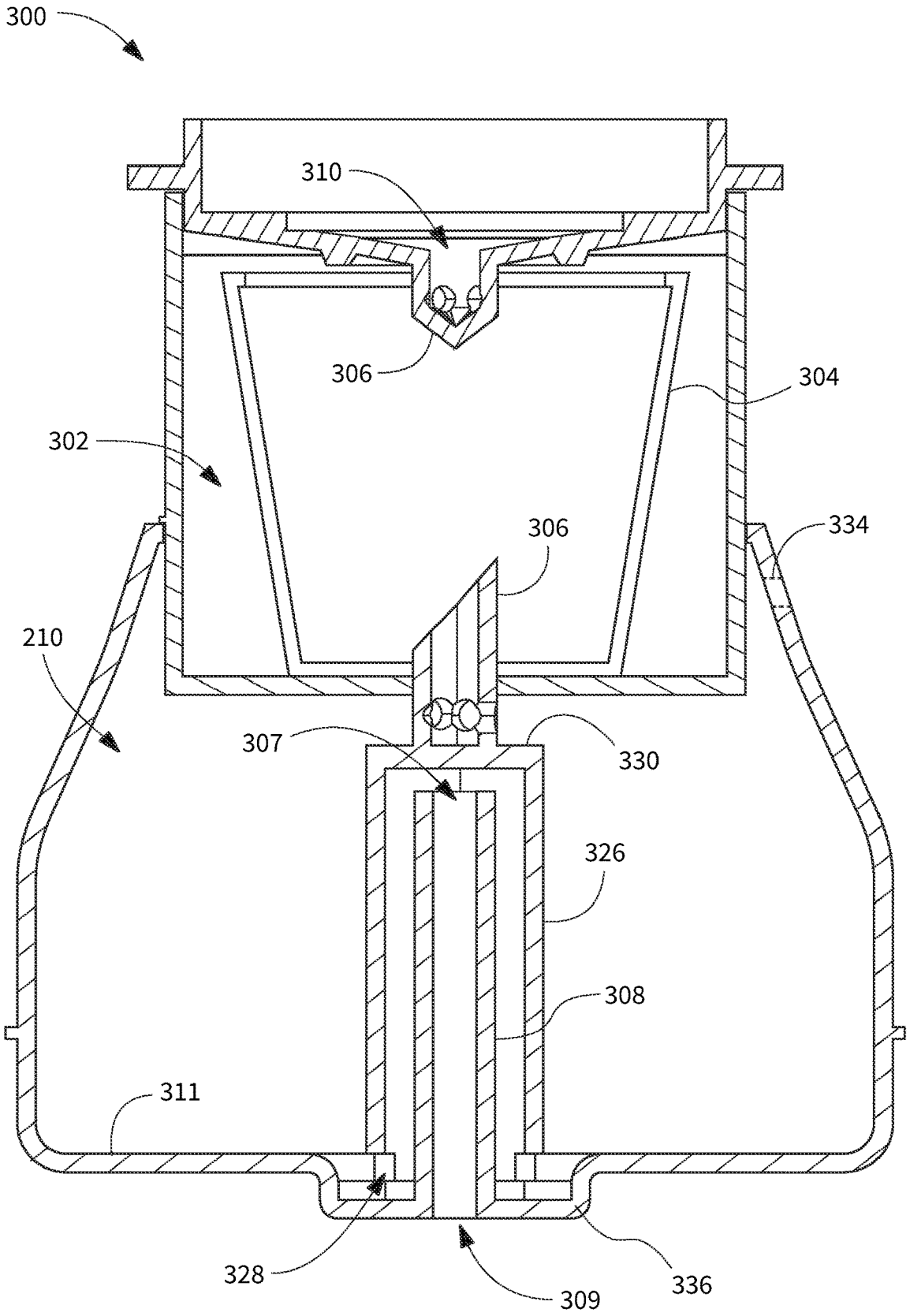
FIG. 16 provides a section view of the pod receiver of FIGS. 13 through 15.

As may be seen in the section views provided in FIGS. 15 and 16, in some embodiments the vertical siphon tube 308 and removable siphon cap 326 (e.g., as described above in reference to FIGS. 9 and 10) may be provided in the removable pod receiver 300. For example, the outlet 309 (see, e.g., FIG. 16) of the siphon tube 308 may be positioned in the receptacle 270 of the mold body 220 and upstream of the channel(s) 314. Additional exemplary features of the pod receiver 300 and siphon mechanism may be seen in FIG. 16 in particular. In some embodiments, e.g., as illustrated in FIG. 16, an air relief port 334 may be provided in the pod receiver 300, e.g., at an upper portion, such as an upper half or upper one-third, of the mixing chamber 210. The air relief port 334 may provide pressure relief, e.g., to avoid or reduce creating a negative pressure within the mixing chamber 210 when the siphon mechanism is activated.

In some embodiments, e.g., as illustrated in FIG. 16, a recess 336 may be formed in the floor 311 of the mixing chamber 210. The removable siphon cap 326 may be at least partially received within the recess 336, such that the recess 336 may help locate the siphon cap 326. The inlet 328 of the siphon cap 326 may be positioned above the recess 336, such that the siphon flow path between the siphon cap 326 and the siphon tube 308 begins in the recess 336. The siphon tube 308 may extend through the floor 311 of the mixing chamber 210 at the recess 336, such as the siphon tube 308 may be concentric with the recess 336, such as the outlet 309 of the siphon tube 308 may be defined at or below a lowermost outer surface of the recess 336.

Figure 17:
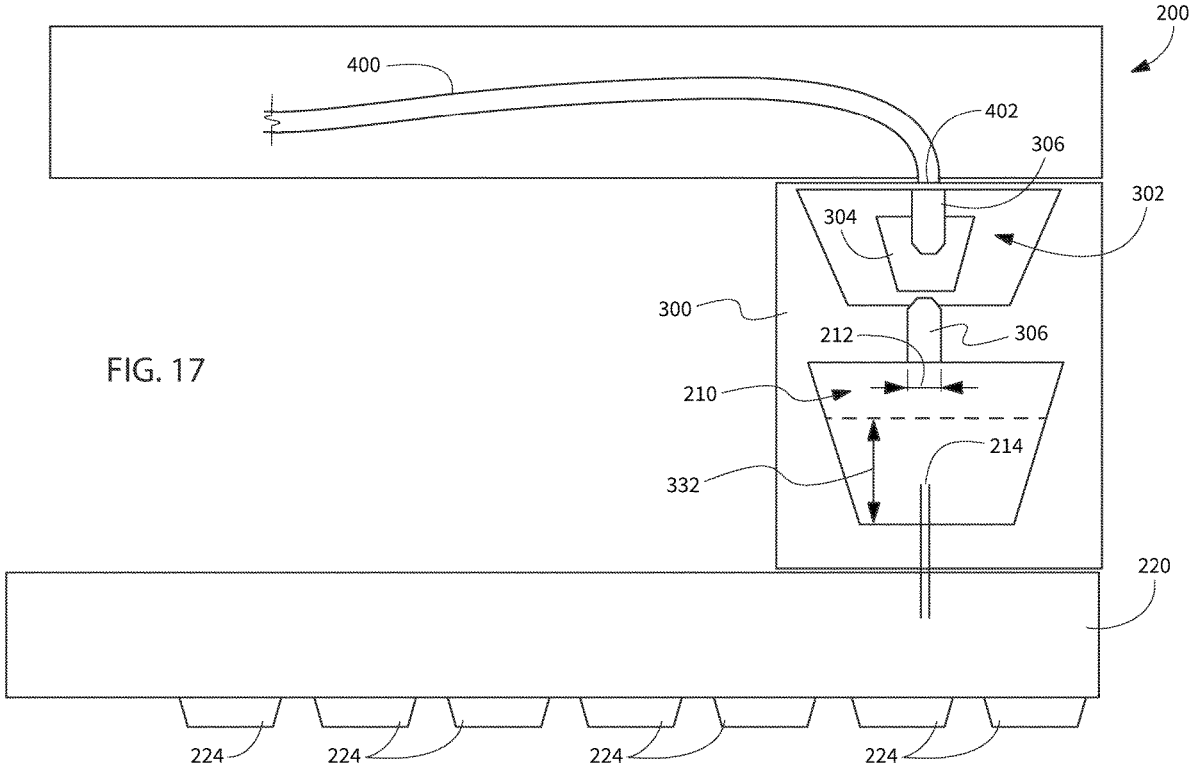
FIG. 17 provides a schematic illustration of still another exemplary mixing chamber of an ice maker in accordance with one or more additional exemplary embodiments of the present disclosure.

In some embodiments, e.g., as illustrated in FIG. 17, the mixing chamber 210 may include an inlet 212 and an outlet 214. In such embodiments, the additive and the amount of water may flow into the mixing chamber 210 via the inlet 212 and may flow to the mold cavity 220 from the mixing chamber 210 via the outlet 214. The outlet 214 may be much smaller than the inlet 212, such that the volume of liquid is retained in the mixing chamber 210 for a period of time, e.g., because the outflow rate through the much smaller outlet 214 is significantly lower than the inflow rate through the larger inlet 212. Thus, in such embodiments, the inlet 212 and the outlet 214 of the mixing chamber 210 may be sized and configured, e.g., based on the relative size of each in proportion to each other and the overall volume of the mixing chamber 210, to provide a predetermined contact time or a predetermined mixing time in the mixing chamber 210. The inlet 212 and the outlet 214 of the mixing chamber 210 may be sized and configured such that the volume of liquid accumulates within the mixing chamber 210 to a predetermined height 332. For example, an inner diameter of the inlet 212 may be at least twice as large as an inner diameter of the outlet 214, such as the inner diameter of the inlet 212 may be three time as large as the inner diameter of the outlet 214, such as the inner diameter of the inlet 212 may be five time as large as the inner diameter of the outlet 214.

Figure 18:
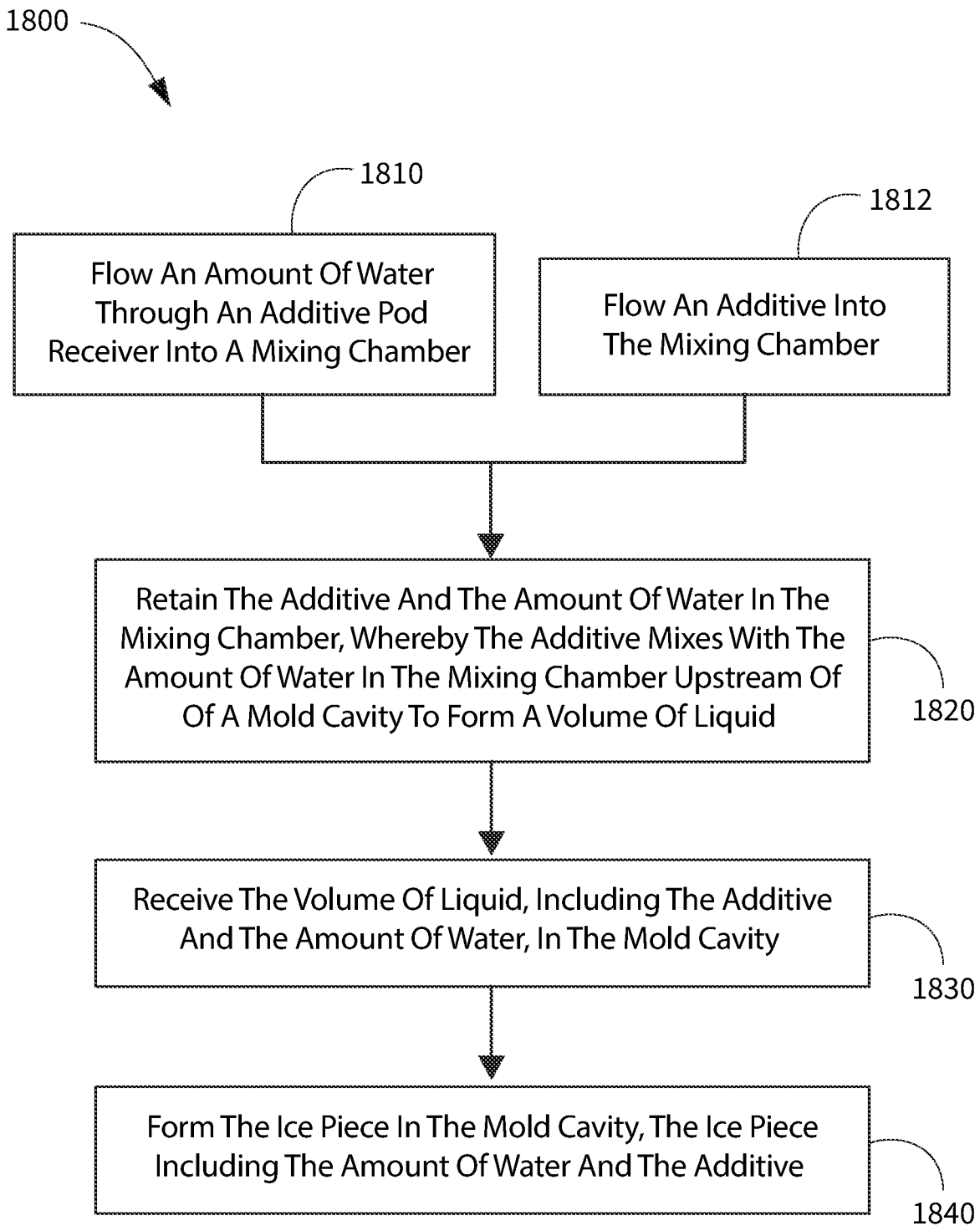
FIG. 18 provides an exemplary flow chart diagram of a method of operating an ice maker appliance according to one or more exemplary embodiments of the present disclosure.

Turning now to FIG. 18, embodiments of the present disclosure also include methods of operating an ice maker appliance, such as methods which include forming and/or producing infused ice comprising water and an additive, e.g., flavorant. FIG. 18 illustrates an exemplary method 1800 of operating an ice maker appliance. Method 1800 may be used with a variety of ice maker appliances, such as the refrigerator appliance 100 described herein. For example, the ice maker appliance may include a mold body comprising a mold cavity and a pod receiver upstream of the mold cavity along a flow path of liquid water. The mold cavity may be configured for receiving a volume of liquid therein and retaining the volume of liquid to form an ice piece in the mold cavity. The pod receiver may include a pod receiver slot configured to hold a pod containing an additive. The ice maker appliance may further include a mixing chamber downstream of the pod receiver slot and upstream of the mold body.

As shown in FIG. 18, method 1800 may include (1810) flowing an amount of water (e.g., liquid water, as will be recognized herein throughout, references to "flowing" water refer to liquid water) through the pod receiver slot into the mixing chamber and (1812) flowing the additive into the mixing chamber. For example, the additive may be flowed into the mixing chamber via the amount of liquid water, e.g., as discussed above, the amount of liquid water may extract the additive from the pod and the extracted additive may then be transported, e.g., flowed, into the mixing chamber by and/or with the flowed amount of liquid water. Method 1800 may further include (1820) retaining the additive and the amount of water in the mixing chamber. As a result of such retention, the additive mixes with the amount of water in the mixing chamber upstream of the mold cavity to form the volume of liquid, e.g., the additive and the water mix while being retained in the mixing chamber. For example, (1820) retaining the additive and the amount of water in the mixing chamber may include retaining the additive and the amount of water for a predetermined holding time or contact time to allow complete mixing to occur in the mixing chamber (or generally complete mixing, e.g. about 90% mixing where at least about 90% of the total volume of liquid comprising the mixture, water, and additive is the mixture).

In some embodiments, flowing the amount of water through the pod receiver into the mixing chamber may include flowing the amount of water through the pod in the pod receiver slot.

In some embodiments, flowing the amount of water through the pod receiver may include flowing a first portion of the amount of water through the pod receiver, waiting for a mixing time (e.g., a predetermined holding time or contact time), and flowing a second portion of the amount of water through the pod receiver after the mixing time has elapsed, e.g., after waiting for the mixing time. In embodiments which include flowing first and second portions of the amount of water separately, such as before and after a mixing time, the first portion of the amount of water and the second portion of the amount of water may make up the entire amount of liquid water, e.g., collectively, such as the first portion of the amount of water plus the second portion of the amount of water may equal the entire amount of water.

The first portion of the amount of water may be much larger than the second portion of the amount of water, which may promote more complete mixing of the water with the additive during the mixing time in the mixing chamber, whereas the second portion of the amount of water may be just enough to cause the volume of liquid to flow out of the mixing chamber, such as by reaching a maximum fill volume within the mixing chamber and/or activating a siphon mechanism. For example, the first portion of the amount of water may be at least eighty percent of the entire amount of liquid water, such as the first portion of the amount of water may be ninety percent of the entire amount of liquid water, such as the first portion of the amount of water may be ninety-five percent of the entire amount of liquid water.

In some embodiments, receiving the volume of liquid by the mold cavity may include receiving the volume of liquid from the mixing chamber through a siphon mechanism. For example, the siphon mechanism may include a siphon tube with a bend that defines the height at which the siphon mechanism is activated. As another example, the siphon mechanism may include a straight siphon tube and a siphon cap, such as a removable siphon cap.

In some embodiments, method 1800 may further include flowing the additive and the amount of water to the mold cavity at a first rate. In such embodiments, flowing the amount of water through the pod receiver into the mixing chamber may include flowing the amount of water into the mixing chamber at a second rate, and flowing the additive into the mixing chamber may include flowing the additive into the mixing chamber at a third rate. In some embodiments, the second and third rates may be the same or approximately the same, such as in embodiments where the amount of water and the additive flow into the mixing chamber together. The rate of flow from the mixing chamber, e.g., the first rate, may be much slower than the rate (or both rates when the water and additive flow in at different rates) of flow into the mixing chamber. Such slow outflow may cause the additive and the liquid water to be retained in the mixing chamber and may thereby promote mixing of the amount of water and the additive in the mixing chamber. For example, the first rate may be less than half of the second rate and/or the first rate may be less than half of the third rate, such as the first rate may be about one third of the second rate and/or third rate, such as the first rate may be about one fourth of the second rate and/or third rate, such as the first rate may be about one tenth of the second rate and/or third rate.

As may be seen from the present disclosure, provided herein is an ice maker appliance configured for making infused ice, e.g., forming one or more ice pieces from liquid water and an additive. The ice maker appliance includes an ice making assembly or ice maker which may be incorporated in a refrigerator appliance, a stand-alone ice maker appliance or other suitable ice maker appliance. The ice maker appliance may also include a mold body comprising a mold cavity. The mold cavity may be configured for receiving a volume of liquid water therein and retaining the volume of liquid water to form an ice piece in the mold cavity. The ice maker appliance may also include a pod receiver having a pod receiver slot configured to hold a pod containing an additive with a mixing chamber downstream of the pod receiver slot and upstream of the mold cavity, such that the additive mixes with the volume of liquid water in the mixing chamber before flowing to the mold cavity, and, therefore, the formed ice piece includes the amount of water and the additive.

The amount of water and the additive (the additive also being in a liquid state) may be retained in the mixing chamber long enough to promote generally complete mixing of the amount of water and the additive, but not long enough to freeze in the mixing chamber. For example, the mixing chamber may be thermally insulated to reduce or avoid freezing the volume of liquid in the mixing chamber. In various embodiments, the volume of liquid may flow slowly from the mixing chamber to the mold cavity, such as through a small outlet from the mixing chamber, and/or the volume of liquid may flow from the mixing chamber to the mold cavity via a siphon mechanism. Such slow flow embodiments may advantageously provide a relatively simple structure with fewer total parts that may be easier to clean and maintain. Additionally, the constant (albeit slow) flow in such embodiments may further serve to reduce or avoid freezing the volume of liquid in the mixing chamber. The siphon mechanism embodiments may provide a more complete and uniform mixing, as well as greater control over the mixing time based on the delay between flowing a first portion of the amount of water and a second portion of the amount of water. The additive may be a flavorant or may include flavor ingredients, such as sugar. Thus, the additive may be sticky or may have a tendency to leave a sticky residue behind, e.g., in the mixing chamber after the volume of liquid flows to the mold cavity. Embodiments which include a recess in the floor of the mixing chamber may promote cleaning the mixing chamber, such as by confining such residue to a limited area within the mixing chamber. Additionally, in embodiments which include a siphon cap, providing the siphon cap as a removable cap may also promote cleaning, e.g., by providing easier access to areas of the mixing chamber for cleaning when the siphon cap is removed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice maker appliance, comprising:

a cabinet;

a chilled chamber defined in the cabinet, the chilled chamber configured to receive a flow of chilled air, whereby an internal temperature within the chilled chamber is at or below the freezing point of water;

an ice maker positioned in the chilled chamber, the ice maker comprising a mold body, a pod receiver, and a mixing chamber, the mold body comprising a mold cavity, the pod receiver upstream of the mold cavity along a flow path of liquid water, the pod receiver comprising a pod receiver slot configured to hold a pod containing an additive, the mixing chamber downstream of the pod receiver slot and upstream of the mold body; and a controller, the controller configured for flowing an amount of liquid water along the flow path through the pod receiver slot into the mixing chamber, whereby the additive flows into the mixing chamber with the amount of liquid water, wherein the mixing chamber is configured to retain the amount of liquid water and the additive for a holding time, whereby the additive mixes with the amount of water in the mixing chamber upstream of the mold cavity to form a volume of liquid, wherein the holding time is longer than a mixing time for the additive and the amount of water to form the volume of liquid and the holding time is shorter than a freezing time of the volume of liquid, the mold cavity configured for receiving the volume of liquid therein and retaining the volume of liquid to form an ice piece in the mold cavity, whereby the ice piece formed in the mold cavity comprises the amount of water and the additive.

2. The ice maker appliance of claim 1, wherein the mixing chamber comprises an inlet and an outlet, wherein the additive and the amount of liquid water flow into the mixing chamber via the inlet and flow to the mold cavity via the outlet, and wherein an inner diameter of the inlet is at least twice as large as an inner diameter of the outlet, whereby an inflow rate through the inlet is greater than an outflow rate through the outlet such that the volume of liquid accumulates within the mixing chamber, whereby flowing the amount of water by the controller comprises providing a constant flow through the mixing chamber, and whereby the holding time of the mixing chamber is defined by the inflow rate through the inner diameter of the inlet, the outflow rate through the inner diameter of the outlet, and an overall volume of the mixing chamber, whereby the volume of liquid accumulates within the mixing chamber to a predetermined height.

3. The ice maker appliance of claim 1, further comprising a siphon mechanism between the mixing chamber and the mold body, wherein the volume of liquid is received by the mold cavity from the mixing chamber via the siphon mechanism, wherein flowing the amount of water through the pod receiver slot into the mixing chamber comprises flowing a first portion of the amount of water, waiting for the holding time, and flowing a second portion of the amount of water after the holding time, wherein the first portion of the amount of water and the second portion of the amount of water collectively activate the siphon mechanism based on a height defined by the siphon mechanism.

4. The ice maker appliance of claim 3, wherein the siphon mechanism comprises a siphon tube extending into the mixing chamber.

5. The ice maker appliance of claim 3, wherein the siphon mechanism comprises a siphon tube entirely outside of the mixing chamber.

6. The ice maker appliance of claim 3, wherein the siphon mechanism comprises a siphon tube and a removable siphon cap.

7. The ice maker appliance of claim 6, wherein an outlet of the siphon tube is positioned in a recess in a floor of the mixing chamber.

8. The ice maker appliance of claim 3, further comprising a port in fluid communication with the mixing chamber, the port configured to provide pressure relief in the mixing chamber.

9. The ice maker appliance of claim 1, wherein the mold body is removable from the ice maker appliance.

10. The ice maker appliance of claim 1, wherein the pod receiver is removable from the mold body.

11. A method of operating an ice maker appliance, the ice maker appliance comprising a cabinet with a chilled chamber defined in the cabinet and an ice maker positioned in the chilled chamber, the ice maker comprising a mold body comprising a mold cavity, the mold cavity configured for receiving a volume of liquid therein and retaining the volume of liquid to form an ice piece in the mold cavity, a pod receiver upstream of the mold cavity along a flow path of liquid water, the pod receiver comprising a pod receiver slot configured to hold a pod containing an additive, and a mixing chamber downstream of the pod receiver slot and upstream of the mold body, the method comprising:

directing chilled air to the chilled chamber, whereby an internal temperature within the chilled chamber is at or below the freezing point of water;

flowing an amount of water through the pod receiver slot into the mixing chamber;

flowing the additive into the mixing chamber;

retaining the additive and the amount of water in the mixing chamber for a holding time, whereby the additive mixes with the amount of water in the mixing chamber upstream of the mold cavity to form the volume of liquid, wherein the holding time is longer than a mixing time for the additive and the amount of water to form the volume of liquid and the holding time is shorter than a freezing time of the volume of liquid;

receiving the volume of liquid in the mold cavity, wherein the volume of liquid comprises the additive and the amount of water; and forming the ice piece in the mold cavity, wherein the ice piece formed in the mold cavity comprises the amount of water and the additive.

12. The method of claim 11, wherein flowing the amount of water through the pod receiver slot into the mixing chamber comprises flowing the amount of water through the pod in the pod receiver slot.

13. The method of claim 11, wherein flowing the amount of water through the pod receiver slot comprises flowing a first portion of the amount of water through the pod receiver slot, waiting for the holding time, and flowing a second portion of the amount of water through the pod receiver slot, whereby the second portion of the amount of water causes the volume of liquid to flow out of the mixing chamber.

14. The method of claim 13, wherein the first portion of the amount of water and the second portion of the amount of water comprise the entire amount of liquid water.

15. The method of claim 13, wherein the first portion of the amount of water is at least eighty percent of the entire amount of liquid water.

16. The method of claim 11, wherein receiving the volume of liquid by the mold cavity comprises receiving the volume of liquid from the mixing chamber through a siphon mechanism, the method further comprising activating the siphon mechanism after the holding time.

17. The method of claim 16, wherein the ice maker comprises a port in fluid communication with the mixing chamber, whereby negative pressure within the mixing chamber is not created when the siphon mechanism is activated.

18. The method of claim 11, further comprising flowing the additive and the amount of water to the mold cavity at a first rate, wherein flowing the amount of water through the pod receiver slot into the mixing chamber comprises flowing the amount of water into the mixing chamber at a second rate, wherein flowing the additive into the mixing chamber comprises flowing the additive into the mixing chamber at a third rate, and wherein the first rate is less than half of the second rate or the third rate, whereby the additive and the liquid water are retained in the mixing chamber for the holding time.

19. The method of claim 18, wherein the second rate is approximately equal to the third rate.

* * * * *